US009757633B2

(12) United States Patent
Bauman

(10) Patent No.: US 9,757,633 B2
(45) Date of Patent: Sep. 12, 2017

(54) HOCKEY PUCK

(71) Applicant: 28 Engineering LLC, Myrtle Beach, SC (US)

(72) Inventor: Walter Douglas Bauman, Wixom, MI (US)

(73) Assignee: 28 Engineering LLC, Myrtle Beach, SC (US)

( * ) Notice: Subject to any disclaimer, the term of this patent is extended or adjusted under 35 U.S.C. 154(b) by 0 days.

(21) Appl. No.: 15/111,654

(22) PCT Filed: Jan. 21, 2015

(86) PCT No.: PCT/US2015/012157
§ 371 (c)(1),
(2) Date: Jul. 14, 2016

(87) PCT Pub. No.: WO2015/112539
PCT Pub. Date: Jul. 30, 2015

(65) Prior Publication Data

US 2016/0332052 A1 Nov. 17, 2016

Related U.S. Application Data

(60) Provisional application No. 61/929,713, filed on Jan. 21, 2014.

(51) Int. Cl.
*A63B 67/14* (2006.01)

(52) U.S. Cl.
CPC ..... *A63B 67/14* (2013.01)

(58) Field of Classification Search
CPC .... A63B 2243/0041; A63B 2243/0045; A63B 67/14; G05B 2219/37134
USPC ..... 473/570, 588
See application file for complete search history.

(56) References Cited

U.S. PATENT DOCUMENTS

| | | | | |
|---|---|---|---|---|
| 5,074,696 | A | 12/1991 | Tanaka | |
| 5,472,193 | A * | 12/1995 | Everman | A63B 67/14 473/570 |
| 5,697,858 | A | 12/1997 | Lekavich | |
| 6,010,418 | A | 1/2000 | Lekavich | |
| 6,217,468 | B1 * | 4/2001 | Goodwin | A63B 67/14 473/588 |
| 6,277,042 | B1 * | 8/2001 | Lekavich | A63B 67/14 473/588 |
| 6,440,018 | B2 | 8/2002 | Lekavich | |

(Continued)

FOREIGN PATENT DOCUMENTS

| | | | | |
|---|---|---|---|---|
| CH | WO 2014000117 A1 * | 1/2014 | | A63F 5/041 |
| GB | 2208002 | 2/1989 | | |
| GB | 2208002 A * | 2/1989 | | G01C 19/04 |

OTHER PUBLICATIONS

International Preliminary Report on Patentability for Application No. PCT/US2015/012157 dated Aug. 4, 2016.

(Continued)

*Primary Examiner* — Aarti B Berdichevsky
*Assistant Examiner* — Rayshun Peng
(74) *Attorney, Agent, or Firm* — Carlson, Gaskey & Olds, P.C.

(57) ABSTRACT

An exemplary hockey puck includes a gyroscope within an outer shell. An exemplary method of controlling movement of a hockey puck includes holding a gyroscope within an outer housing of a hockey puck.

17 Claims, 7 Drawing Sheets

(56) References Cited

U.S. PATENT DOCUMENTS

| | | | | |
|---|---|---|---|---|
| 2003/0148823 | A1 | 8/2003 | Nesbitt et al. | |
| 2007/0037636 | A1 | 2/2007 | Wong | |
| 2010/0263167 | A1* | 10/2010 | Fox | F16F 7/104<br>16/400 |
| 2015/0148155 | A1* | 5/2015 | Robustelli | A63F 5/041<br>473/588 |

OTHER PUBLICATIONS

International Search Report and Written Opinion for Application No. PCT/US2015/012157 dated May 8, 2015.

* cited by examiner

HOCKEY PUCK

CROSS-REFERENCE TO RELATED APPLICATIONS

This application claims priority to U.S. Provisional Application No. 61/929,713, which was filed on 21 Jan. 2014 and is incorporated herein by reference.

BACKGROUND

This disclosure relates generally to a hockey puck and, more particularly, to a street or inline hockey puck.

Sports are played on many surfaces. As an example, the playing surface for ice hockey is ice. Other types of hockey are played on other playing surfaces. Inline or street hockey, in contrast to ice hockey, is played on playing surfaces other than ice, such as asphalt, plastic, or concrete. The athletes may move across those playing surfaces during a game using inline roller skates. Inline hockey allows athletes to practices hockey skills when ice is not available. Athletes often desire to mimic ice hockey movements when playing inline hockey.

Pucks used for ice hockey are typically rubber. A relatively high sliding friction between rubber pucks and inline hockey playing surfaces prevents rubber pucks from frequent use in street hockey. Simply, a rubber puck does not slide effectively on street surfaces.

Accordingly, specific pucks for street hockey have been developed. Existing street hockey pucks can be difficult to handle and may undesirably move in a way that differs from a rubber puck movement in ice hockey. Undesirable movements can include the inline hockey puck bouncing.

SUMMARY

A hockey puck according to an exemplary aspect of the present disclosure includes, among other things, a gyroscope within an outer shell.

In a further non-limiting embodiment of the foregoing hockey puck, the outer shell is cylindrical and extends lengthwise along an axis, the gyroscope rotatable relative to the outer shell about the axis.

In a further non-limiting embodiment of any of the foregoing hockey pucks, the gyroscope includes a plurality of inertial pins within a gyroscope housing.

In a further non-limiting embodiment of any of the foregoing hockey pucks, the plurality of inertial pins are distributed annularly about the axis, the plurality of inertial pins each includes a stem portion extending toward the axis from an enlarged head.

In a further non-limiting embodiment of any of the foregoing hockey pucks, the enlarged head is positioned radially inside a radially outermost surface of the gyroscope housing.

In a further non-limiting embodiment of any of the foregoing hockey pucks, the inertial pins are received within a radially extending slot of the gyroscope housing and the inertial pins are radially slidable relative to the gyroscope housing.

In a further non-limiting embodiment of any of the foregoing hockey pucks, the hockey puck further includes a pivot nub extending from one of the gyroscope housing or the outer housing that is received within a recess in the other of the gyroscope housing or the outer housing. The pivot nub contacts a side of the recess to limit radial movement of the gyroscope housing relative to the outer housing.

In a further non-limiting embodiment of any of the foregoing hockey pucks, the gyroscope is received within a cavity of the outer housing. The gyroscope is moveable axially within the cavity relative to the outer housing. The gyroscope contacts the outer housing to block the pivot nub from fully withdrawing from the recess.

In a further non-limiting embodiment of any of the foregoing hockey pucks, the outer shell completely covers the gyroscope.

In a further non-limiting embodiment of any of the foregoing hockey pucks, the hockey puck further includes a plurality of glide pins securing a first portion of the outer housing to a second portion of the outer housing, the gyroscope housed within a cavity provided by the first portion and the second portion.

In a further non-limiting embodiment of any of the foregoing hockey pucks, each glide pin within the plurality of glide pins includes a head protruding axially past an outermost axially facing surface of the first portion or the second portion.

A method of controlling movement of a hockey puck according to an exemplary aspect of the present disclosure includes, among other things, holding a gyroscope within an outer housing of a hockey puck.

In a further non-limiting embodiment of the foregoing method, the method further includes spinning the gyroscope about an axis, the spinning relative to the outer housing.

In a further non-limiting embodiment of any of the foregoing methods, the spinning causes inertial pins of the gyroscope to slide radially outward relative to a gyroscope housing of the gyroscope.

In a further non-limiting embodiment of any of the foregoing methods, the outer housing completely covers the gyroscope.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
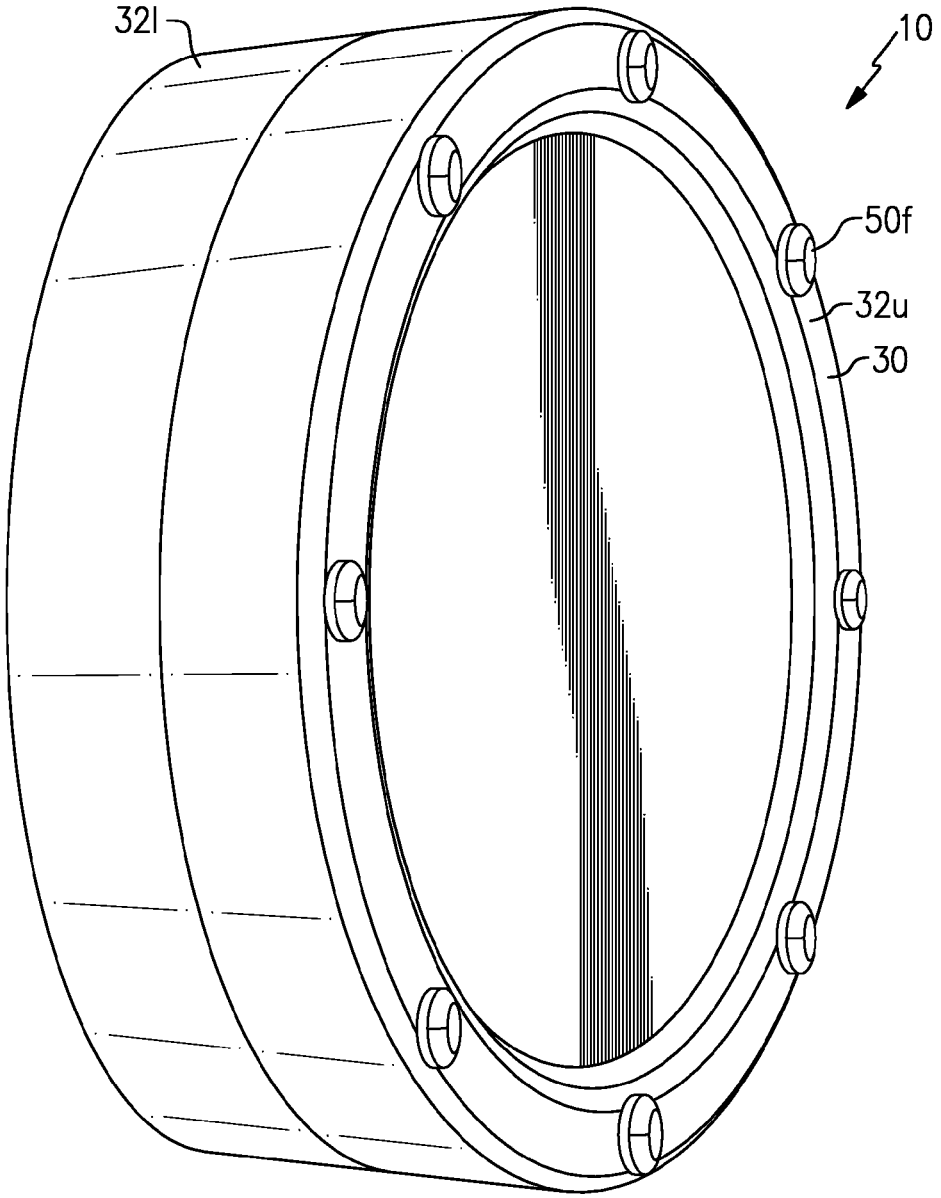
FIG. 1 shows an example inline hockey puck.
Figure 2:
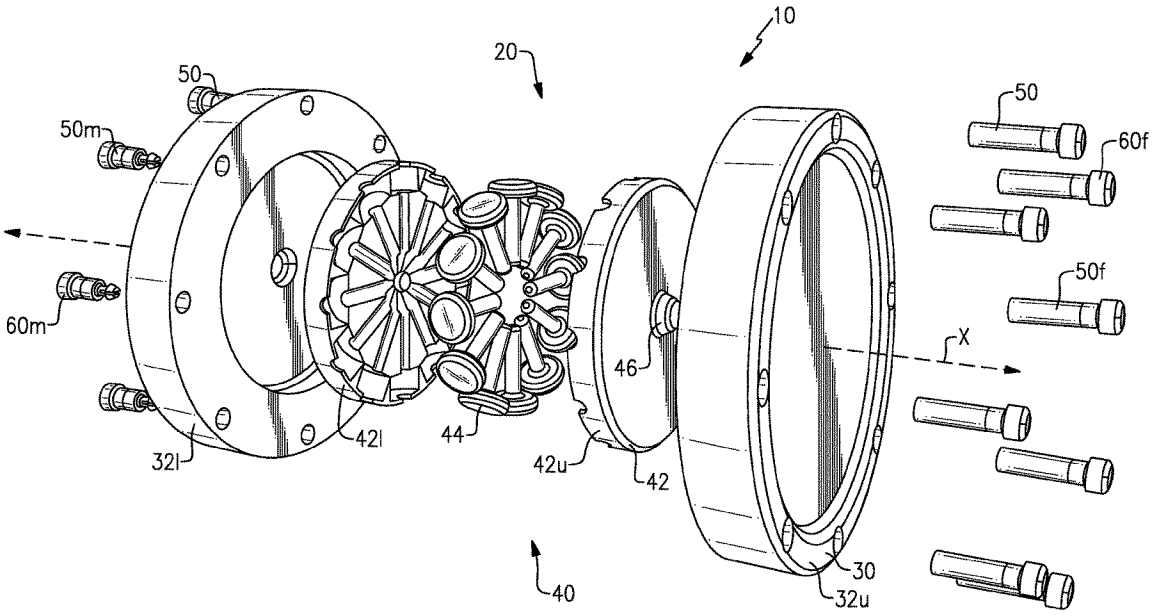
FIG. 2 shows an exploded view of the inline hockey puck of FIG. 1.
Figure 3:
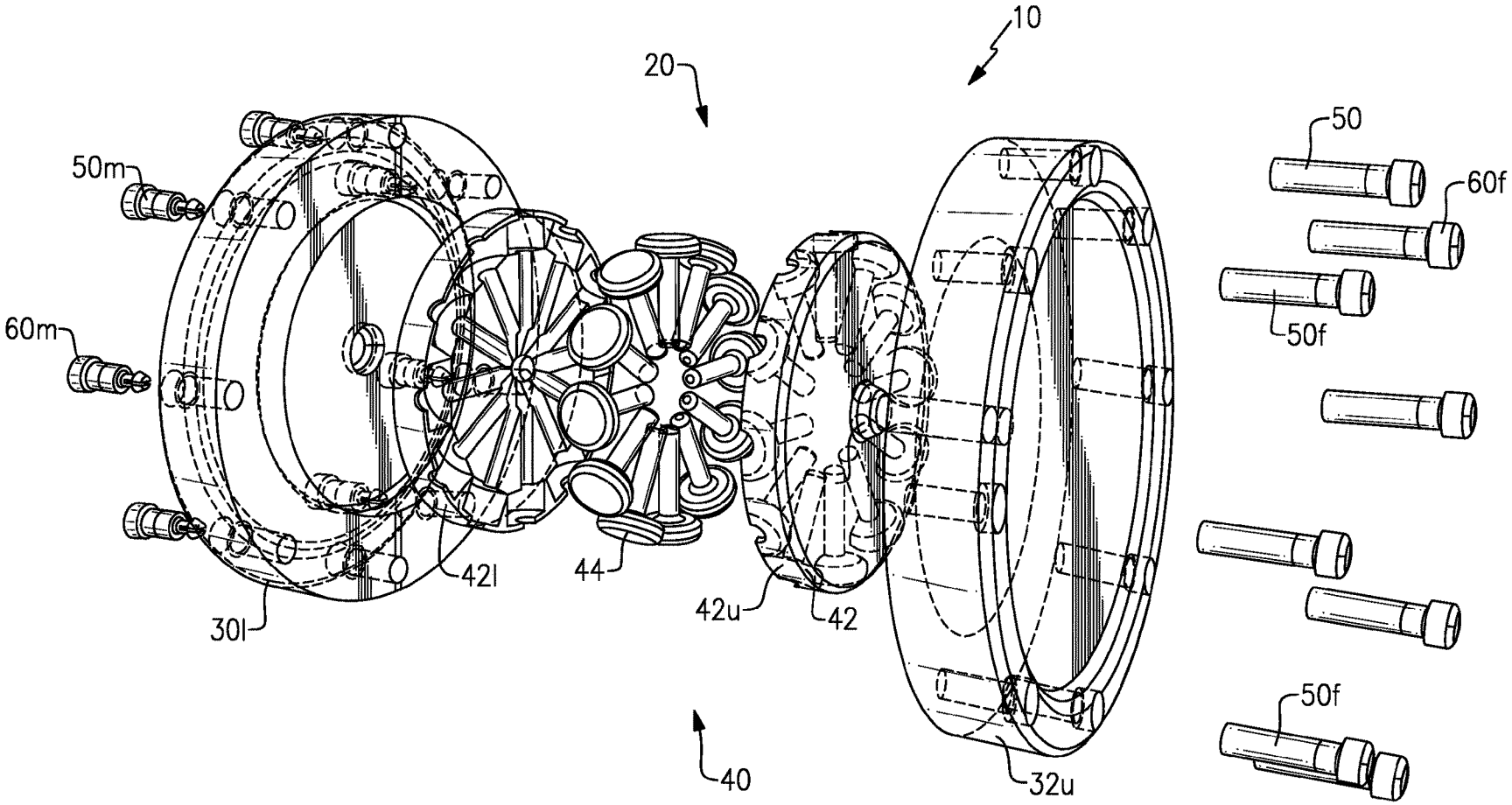
FIG. 3 shows another exploded view of the inline hockey puck of FIG. 1.
Figure 4:
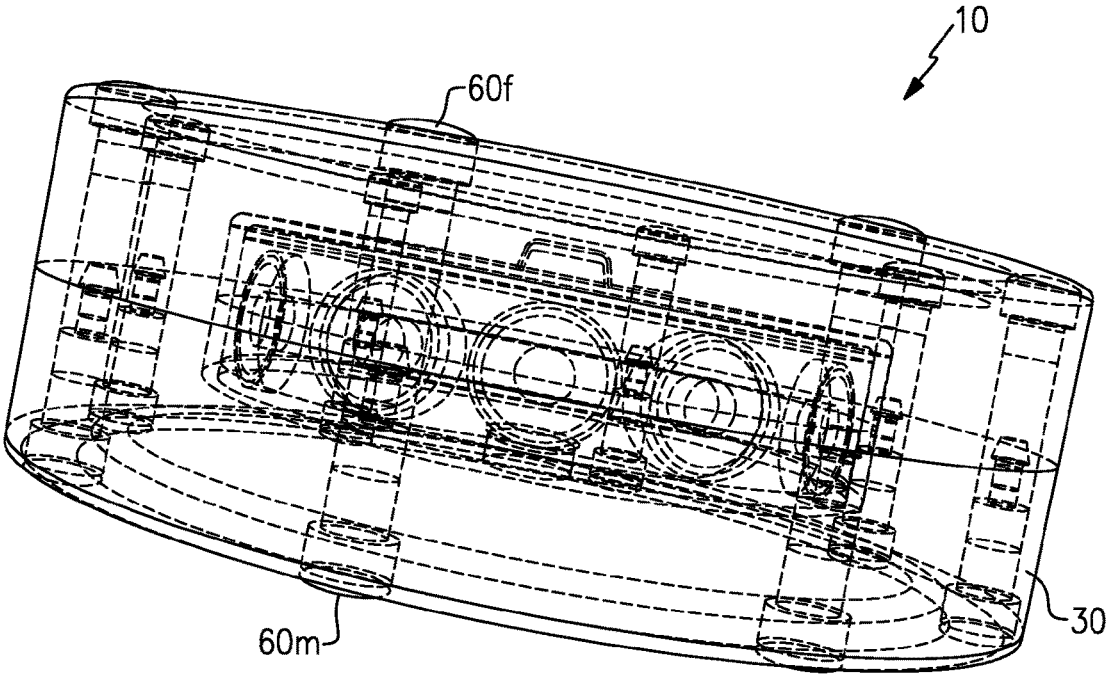
FIG. 4 shows another view of the inline hockey puck of FIG. 1.

Referring to FIGS. 1 to 4, in one example, a puck 10 incorporates elements that reduce the excessive bouncing.

The puck 10 includes internal elements 20 within an outer housing 30 or shell. The internal elements 20 that operate with rotational and inline events that are out of phase with the primary impact and rotational events of outer housing 30 of the puck 10. Additionally, a latent rotational inertia generated by portions of the internal elements 20 facilitates keeping the puck 10 flat on the playing surface.

The example outer housing 30 includes an upper portion 32*u* and a lower portion 32*l*. The portions 32*u* and 32*l* can be symmetric or nest into each other.

These upper portion 32*u* and 32*l* can be bonded together via chemical bonding or ultrasonic welding. The outer housing 30 can be made of a polymer material.

This example forms the outer housing 30 with two portions 32*u* and 32*l*. More than two portions may be used to form the outer housing 30 in other examples.

The outer housing 30 forms the external facing surface of the puck 10. The outer housing 30 provides the primary surfaces contacted by a hockey stick.

The outer housing 30 provides a circular cavity that receives the internal elements 20. The outer housing 30 completely covers the internal elements 20 in this example.

In this example, the internal elements 20 include a gyroscope 40. The gyroscope includes a gyroscope housing 42 and inertial pins 44.

The gyroscope housing 42 includes an upper portion 42*u* and lower portion 421. The portions 42*u* and 421 can either be symmetric, or nested into each other.

When the puck 10 is assembled, the gyroscope housing 42 can rotate or spin relative to the outer housing 30 about an axis X within the circular cavity. The outer housing 30 is cylindrical and extends lengthwise along the axis X. The gyroscope housing 42 and internal elements 20 can rotated within the cavity relative to the outer housing 30. The example gyroscope housing 42 can be made of a polymer or some other type, or types, of material.

The inertial pins 44 are distributed annularly about the axis X. Twelve of the pins 44 are used in this example but other numbers could be used. The pins 44 may, or may not, be bonded to each other. The internal pins 44 include a stem portion 44*s* extending radially toward the axis X from a head portion 44*h*.

Figure 5:
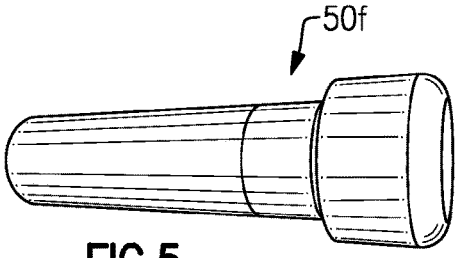
FIG. 5 shows a female guide pin of the FIG. 1 puck.
Figure 6:
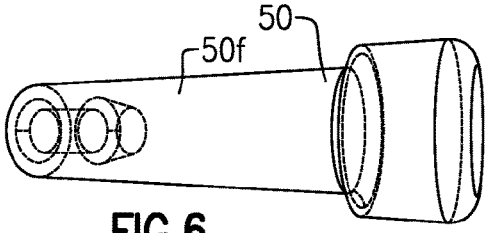
FIG. 6 shows another view of the female guide pin of FIG. 5.
Figure 7:
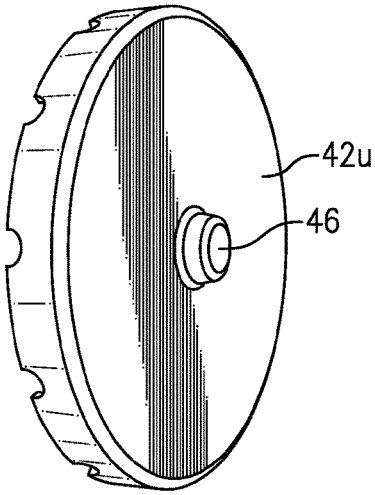
FIG. 7 shows a portion of a gyroscope housing of the FIG. 1 puck.
Figure 8:
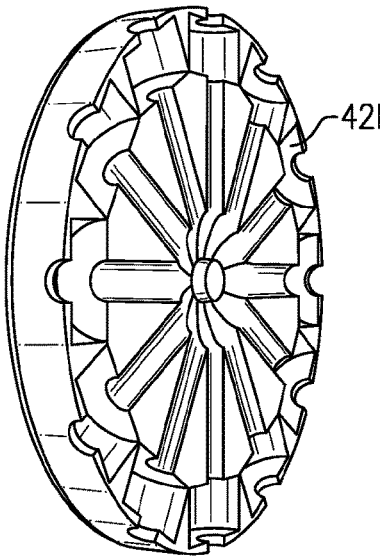
FIG. 8 shows another portion of the gyroscope housing of the FIG. 1 puck.
Figure 9:
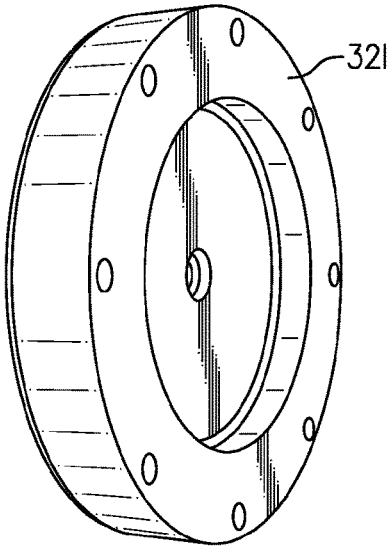
FIG. 9 shows a portion of an outer housing of the FIG. 1 puck.
Figure 10:
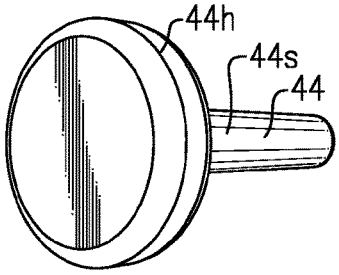
FIG. 10 shows an inertial pin of the FIG. 1 puck.
Figure 11:
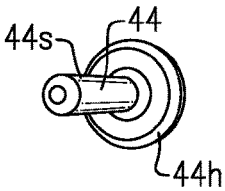
FIG. 11 shows another view of the inertial pin of the FIG. 9.
Figure 12:
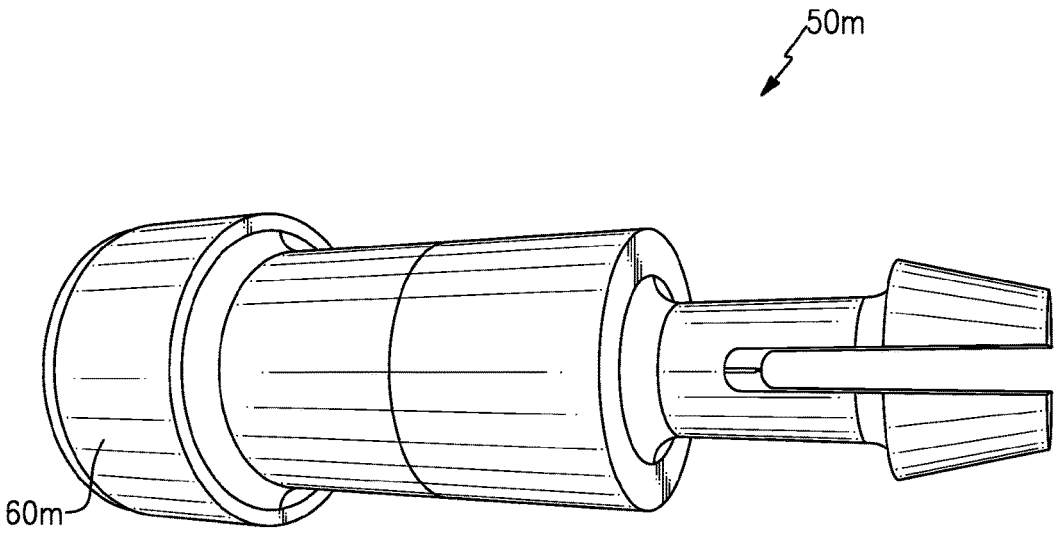
FIG. 12 shows a male guide pin of the FIG. 1 puck.
Figure 13:
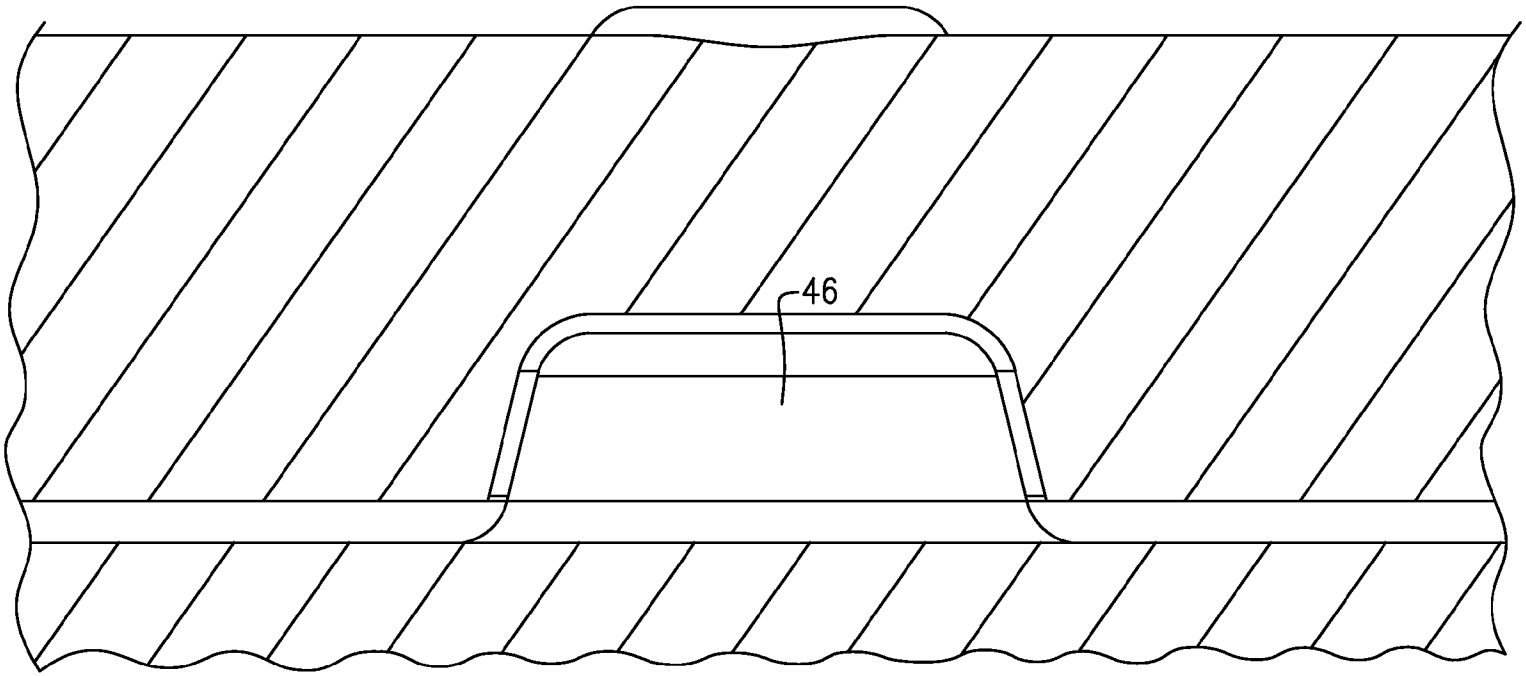
FIG. 13 shows a section view of a nub of the gyroscope housing of FIG. 7 within a recess in the outer housing of FIG. 9.

Referring now to FIGS. 5 to 13 with continuing reference to FIGS. 1 to 4, the internal pins 44 and gyroscope housing 42 are restrained by the pivot nubs 46 that protrude from the gyroscope housing 42 and fit into a recess within the outer housing 30. The nubs 46 are designed such that the fit into the outer housing 30 allows for rotation of the gyroscope housing 42 about the axis X relative to the outer housing 30. The pivot nubs 46 contact the sides of the recess to limit radial movement of the gyroscope housing 42 relative to the outer housing 30.

The fit of the pivot nubs 46 within the respective recesses allows some axial movement of the gyroscope housing 42 and pins 44 along the axis X relative to the outer housing 30, and for some radial movement of the gyroscope housing 42 and pins 44 relative to the outer housing 30. Contact between the gyroscope housing 42 and the outer housing 30 blocks the pivot nubs 46 from withdrawing from the respective recess.

In another example, the gyroscope housing 42 includes a recess that receives a pivot nub extending from the outer housing 30.

The inertial pins 44 are positioned within recesses in the gyroscope housing 42. The recesses allow for primarily radial movement of the pins 44 relative to the axis X and the gyroscope housing 42. The inertial pins 44 are radially slideable relative to the gyroscope housing 42 in this example.

Other movement of the inertial pins 44 relative to the gyroscope housing 42 depend on the tolerances selected for the gyroscope housing 42 to inertia pin 44 fit.

The example inertial pins 44 have two primary functions,

First, the pins 44 provide dampening to impact events, such as a stick strike, by using their radial position to slightly adjust the timing of the compression and rebound of the puck 10. The example pins 44 prolong the compression phase of an impact event, and then reduce the ability of energy to be added back to the rebound phase of an impact event by reducing the ability of stored energy to "push back" on the internal elements 20 of the puck.

Second, the inertial pins 44 add rotational inertia to the gyroscope 40 allowing all the inertial pins 44 to slide radially outward as the gyroscope 40 gains rotational speed. This helps maintain a gyroscope effect to help the puck 10 stay flat to the playing surface.

The inertial pins 44 can be made of polymer material, or some other type of material.

In this example, glide pins 50 are included in the puck 10 to reduce sliding friction during play. There are two types of glide pins 50: male 50*m* and female 50*f*. The male guide pins 50*m* each engage one of the female guide pins 50*f* when the puck 10 is assembled. The example male guide pins 50*m* snap fit to the female guide pins 50*f*.

The male guide pins 50*m* include heads 60*m*, and the female guide pins 50*f* include heads 60*f*. The heads 60*m* protrude axially beyond the outermost surface of the lower housing 32*l*, and the heads 60*f* protrude axially beyond the axially outermost surface of the upper housing 32*u*. The heads 60*m* of the guide pins 50 are exposed. Depending on how the puck 10 is oriented, the heads 60*m* or 60*f* contact the playing surface to reduce the sliding friction to the playing surface.

The guide pins 50 can be made of a polymer material that provides low friction and durability. The guide pins 50 could be made of other materials In some examples, the guide pins 50 could be used to secure the portion 32*u* to the portion 32*l*.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

I claim:

1. A hockey puck, comprising:

a gyroscope within an outer shell, the gyroscope independently rotatable relative to a radially outermost side of the outer shell about an axis, wherein the gyroscope comprises a plurality of inertial pins within a gyroscope housing, wherein the inertial pins are received within a radially extending slot of the gyroscope housing and the inertial pins are radially slidable relative to the gyroscope housing between a first position and a second position, wherein the inertial pin terminates at a radially outermost face, wherein the radially outermost face is radially spaced from the axis a first distance when the inertial pin is in the first position, and the radially outermost face is radially spaced from the axis a second distance when the inertial pin is in the second position, the first distance greater than the second distance, wherein the plurality of inertial pins are distributed annularly about the axis, the plurality of inertial pins each comprises a stem portion extending toward the axis from an enlarged head that provides the radially outermost end portion.

2. The hockey puck of claim 1, wherein the outer shell is cylindrical and extends lengthwise along an axis.

3. The hockey puck of claim 1, further comprising a pivot nub extending from one of the gyroscope housing or the outer housing that is received within a recess in the other of the gyroscope housing or the outer housing, the pivot nub contacting a side of the recess to limit radial movement of the gyroscope housing relative to the outer housing, wherein the axis extends through the pivot nub.

4. The hockey puck of claim 3, wherein the gyroscope is received within a cavity of the outer housing, the gyroscope moveable axially within the cavity relative to the outer housing, the gyroscope contacting the outer housing to block the pivot nub from fully withdrawing from the recess.

5. The hockey puck of claim 1, wherein the outer shell completely covers the gyroscope.

6. The hockey puck of claim 1, further comprising a plurality of glide pins securing a first portion of the outer housing to a second portion of the outer housing, the gyroscope housed within a cavity provided by the first portion and the second portion.

7. The hockey puck of claim 6, wherein the plurality of glide pins are distributed annularly about the axis, the plurality of glide pins extending axially from a first side of the gyroscope to an opposite, second side of the gyroscope, wherein each glide pin within the plurality of glide pins includes a head protruding axially past an outermost axially facing surface of the first portion or the second portion.

8. A method of controlling movement of a hockey puck, comprising:

holding a gyroscope within an outer housing of a hockey puck; and spinning the gyroscope about an axis, the gyroscope spinning relative to a radially outermost side of the outer housing, wherein the spinning causes inertial pins of the gyroscope to slide radially outward relative to a gyroscope housing of the gyroscope, wherein the inertial pins are held within the gyroscope housing but entirely detached from the gyroscope housing such that each of the inertial pins can slide relative to the gyroscope housing.

9. The method of claim 8, wherein the outer housing completely covers the gyroscope.

10. The hockey puck of claim 1, wherein the gyroscope has a first outer diameter, and the outer shell has a second outer diameter greater than the first outer diameter.

11. The hockey puck of claim 1, wherein the gyroscope is contained entirely within the outer shell such no portion of the gyroscope extends radially past a radially outermost surface of the outer shell.

12. The hockey puck of claim 1, wherein the gyroscope is circumferentially surrounded by the outer shell.

13. The hockey puck of claim 1, wherein the gyroscope housing includes portions aligned with the axis that are rotatable with the remaining portions of the gyroscope housing relative to the outer shell.

14. The method of claim 8, wherein each of the inertial pins includes a stem portion extending toward the axis from an enlarged head, wherein the spinning causes the inertial pins of the gyroscope to slide radially outward relative to the gyroscope housing.

15. The method of claim 14, wherein the inertial pins slide from a first position where the enlarged head is further from a radially outermost portion of the gyroscope housing to a second position where the enlarged head is close to the radially outermost portion of the gyroscope housing.

16. A hockey puck, comprising:

a gyroscope having a gyroscope housing that contains a plurality of inertial pins distributed annularly about an axis, the plurality of inertial pins held within recesses of the gyroscope housing and detached from the gyroscope housing such that the inertial pins are slidable relative to the gyroscope housing; and an outer housing having a diameter relative to the gyroscope housing, the gyroscope contained within, and circumferentially bounded by the outer housing, wherein the gyroscope housing is rotatable relative to the outer housing about the axis.

17. The hockey puck of claim 16, wherein the plurality of inertial pins each comprises a stem portion extending toward the axis from an enlarged head.

* * * * *